US010056712B2

(12) United States Patent
Nogrady

(10) Patent No.: US 10,056,712 B2
(45) Date of Patent: Aug. 21, 2018

(54) CUSTOMIZED BACKSHELL FOR CONNECTOR USED FOR STEEL WIRE ARMORED CABLES

(71) Applicant: Honeywell International Inc., Morris Plains, NJ (US)

(72) Inventor: Attila Nogrady, Capalaba (AU)

(73) Assignee: Honeywell International Inc., Morris Plains, NJ (US)

( * ) Notice: Subject to any disclaimer, the term of this patent is extended or adjusted under 35 U.S.C. 154(b) by 123 days.

(21) Appl. No.: 15/139,229

(22) Filed: Apr. 26, 2016

(65) Prior Publication Data

US 2017/0310041 A1 Oct. 26, 2017

(51) Int. Cl.

| | |
|---|---|
| ***H01R 13/58*** | (2006.01) |
| ***H01R 43/033*** | (2006.01) |
| ***H01R 13/59*** | (2006.01) |
| *H01R 43/28* | (2006.01) |

(52) U.S. Cl.

CPC ..... *H01R 13/59* (2013.01); *H01R 43/28* (2013.01)

(58) Field of Classification Search

None

See application file for complete search history.

(56) References Cited

U.S. PATENT DOCUMENTS

| | | | | |
|---|---|---|---|---|
| 3,023,267 | A * | 2/1962 | Eager, Jr. | H01B 7/00 174/113 R |
| 3,068,316 | A * | 12/1962 | Witt | H02G 11/02 174/135 |
| 4,568,401 | A * | 2/1986 | Davis | H01B 7/06 156/55 |
| 6,561,835 | B1 | 5/2003 | Hirschberg et al. | |
| 6,960,102 | B2 | 11/2005 | Styles | |
| 8,292,670 | B2 | 10/2012 | Kreider et al. | |
| 8,410,369 | B2 * | 4/2013 | Kim | H01R 13/6392 174/153 G |
| 9,153,912 | B2 | 10/2015 | Boyden et al. | |

* cited by examiner

*Primary Examiner* — Dimary Lopez Cruz

(74) *Attorney, Agent, or Firm* — Anthony Miologos

(57) ABSTRACT

An apparatus includes a backshell, the backshell having a shell defining an interior space, the interior space configured to encase a portion of a plurality of core cables between an entry component and a connector body in a steel wire armored (SWA) cable, wherein the portion represents an excess amount of the core cables when the SWA cable is uncoiled.

20 Claims, 2 Drawing Sheets

CUSTOMIZED BACKSHELL FOR CONNECTOR USED FOR STEEL WIRE ARMORED CABLES

TECHNICAL FIELD

This disclosure relates generally to connectors. More specifically, this disclosure relates to a custom backshell for a connector used for steel wire armored (SWA) cables.

BACKGROUND

SWA cables are not very flexible. Bending or coiling the non-flexible cable can cause the connector pins to pull out of the pin holder or the wire crimps to let go thereby losing physical contact with the mating connector or receptacle in the remote terminal unit (RTU) enclosure, which leads to production outages caused by well site shutdown.

SUMMARY

This disclosure provides a custom backshell for a connector used for steel wire armored (SWA) cables.

In a first embodiment, a backshell includes a shell defining an interior space. The interior space is configured to encase a portion of a plurality of core cables between an entry component and a connector body in a SWA cable, wherein the portion represents an excess amount of the core cables when the SWA cable is uncoiled.

In a second embodiment, a SWA cable includes a plurality of core cables and a backshell. The plurality of core cables is configured to transmit a signal. The backshell includes a shell defining an interior space, the interior space configured to encase a portion of a plurality of core cables between an entry component and a connector body in a steel wire armored (SWA) cable, wherein the portion represents an excess amount of the core cables when the SWA cable is uncoiled.

In a third embodiment, a method includes coiling a SWA cable having a plurality of core cables. The coiling of the SWA cable causes a reduction in an excess amount of the plurality of core cables disposed in an interior space of a backshell coupled to the SWA cable. The method also includes uncoiling the SWA cable. The uncoiling of the SWA cable causes the excess amount of the core cables to increase in the interior space of the backshell.

Other technical features may be readily apparent to one skilled in the art from the following FIGURES, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 4, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any type of suitably arranged device or system.

A steel wire armored (SWA) multi-core cable often includes a quick/multi pin connector. SWA cables are generally not very flexible and, for that reason, are meant to be laid and completed situ (on-site). In many cases, the SWA cables are manufactured and tested in a workshop before being shipped to a third party supplier for integration. More testing is performed at the client warehouse prior to final installation at site. This means the non-flexible cable is handled as a flexible cable as it is repeatedly coiled and uncoiled and handled at numerous stages in the supply chain. The movement of the outer and inner layer of the SWA cable is inevitable when the cable is subjected to being handled, coiled and uncoiled. It is normal to experience movement between the inner core cable and outer armoring with SWA cables. The outer layer has a different bending radius and amount of compression compared to the inner layer of the cable. This difference allows the inner layer to creep within the outer layer when the cable is bent and coiled. Inner retraction of the inner layer can be as much as fifty millimeters after the first cut of the cable and further retraction of up to six millimeters after coiling a cable fifteen meters long. The inner layer retraction exerts stress on the quick connector pins and crimps as quick connectors allow very limited tolerance for any internal movement once assembled. The above described problem may cause either the connector pins to pull out of the pin holder or the wire crimps to let go of the core cables, thereby losing physical contact with the mating connector or receptacle in the RTU enclosure, which leads to production outages caused by well site shutdown.

Figure 1:
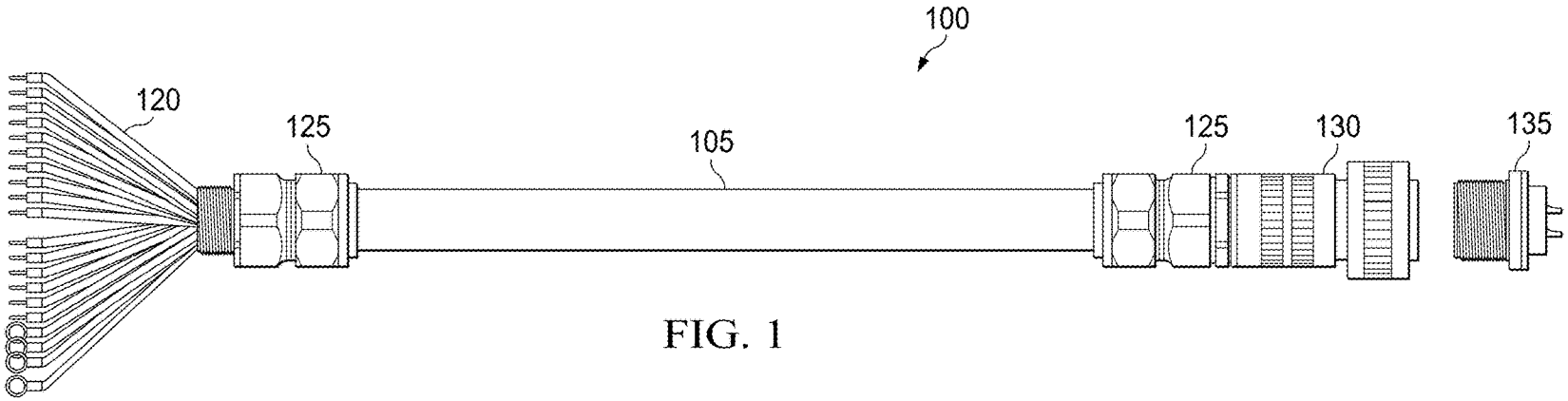
FIG. 1 illustrates an example steel wire armored (SWA) cable according to this disclosure.
Figure 2:
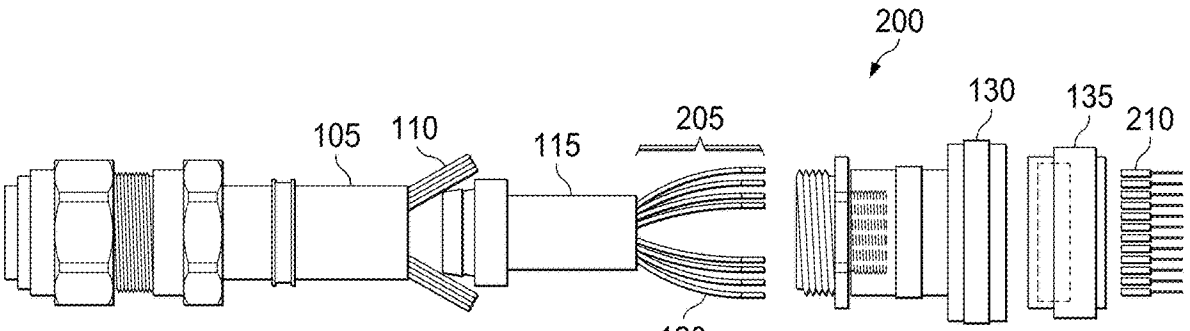
FIG. 2 illustrates an end of the SWA cable according to this disclosure.

FIG. 1 illustrates an example steel wire armored (SWA) cable 100 according to this disclosure. FIG. 2 illustrates an end 200 of the SWA cable 100 according to this disclosure. The embodiment of the SWA cable 100 illustrated in FIG. 1 and the end 200 of the SWA cable 100 illustrated in FIG. 2 are for illustration only. FIGS. 1 and 2 do not limit the scope of this disclosure to any particular implementation.

The SWA cable 100 includes an outer jacket 105, steel armored wires 110, an inner jacket 115, a plurality of core cables 120, a cable gland assembly 125, a backshell 130, and a connection cap 135. The outer jacket 105 provides an outer cover for the SWA cable 100. The steel armored wires 110 provide strength to the SWA cable 100 and add further protection to the plurality of core cables 120. The inner jacket 115 provides a barrier between the steel armored wires 110 and the core cables 120. The core cables 120 are used to transmit a plurality of signals along the SWA cable 100. The cable gland assembly 125 is located at each end of the SWA cable 100. The cable gland assembly 125 connects and secures the inner jacket 115, the steel armor wires 110 and the outer jacket 105.

An excess amount 205 of the core cables 120 extends beyond the cable gland assembly 125 to connect to a connection cap 135 at both ends of the SWA cable 100. The connection cap 135 includes a plurality of pins 210 used to connect the core cables 120 to corresponding pins located in a terminal (not shown). In some embodiments, the connection cap 135 may be (or include) a MS5015 connector by AMPHENOL AEROSPACE. A backshell 130 is provided between the cable gland assembly 125 and the connection cap 135 to encompass and accommodate the excess amount 205 of the core cables 120. The excess amount 205 of the core cables 120 is provided for contraction of the core cables 120 into the SWA cable 100 when the SWA cable 100 is coiled for transport or storage. For example, a fifteen meter long SWA cable 100 can experience fifty millimeters of retraction after cutting the core cables to a suitable length and five millimeters of retraction after coiling. Because of this reduction in length after cutting, the excess amount 205 of the core cables 120 is determined based on the suitable length of the SWA cable 100. The core cables 120 experience a reduction of length after cutting to a suitable size based on the overall length.

The excess amount 205 is also determined based on coiling and uncoiling the SWA cable 100. The core cables 120 have a different bending radius than the SWA cable 100 and the steel armor wires 110 when the SWA cable 100 is coiled. That is, when the SWA cable 100 is coiled, the core cables 120 experience a different bending that causes a portion of the excess amount 205 to retract into the SWA cable 100. When the SWA cable 100 is uncoiled, the excess amount 205 extends out from the end of the SWA cable 100. The fluctuation of the length of the excess amount 205 causes stress on the connections with the pins 210 of the connection cap 135. The stress could cause damage to each connection, reducing the connection or totally uncoupling the core cable from the pin 210. In order to accommodate the fluctuations in excess amount 205 of the core cables 120, a backshell 130 is provided. The backshell is described in detail in regards to FIG. 3.

Although FIGS. 1 and 2 illustrate an example of a SWA cable 100, various changes may be made to FIGS. 1 and 2. For example, while twenty core cables are illustrated in FIG. 1, other embodiments can include more or less than twenty core cables.

Figure 3:
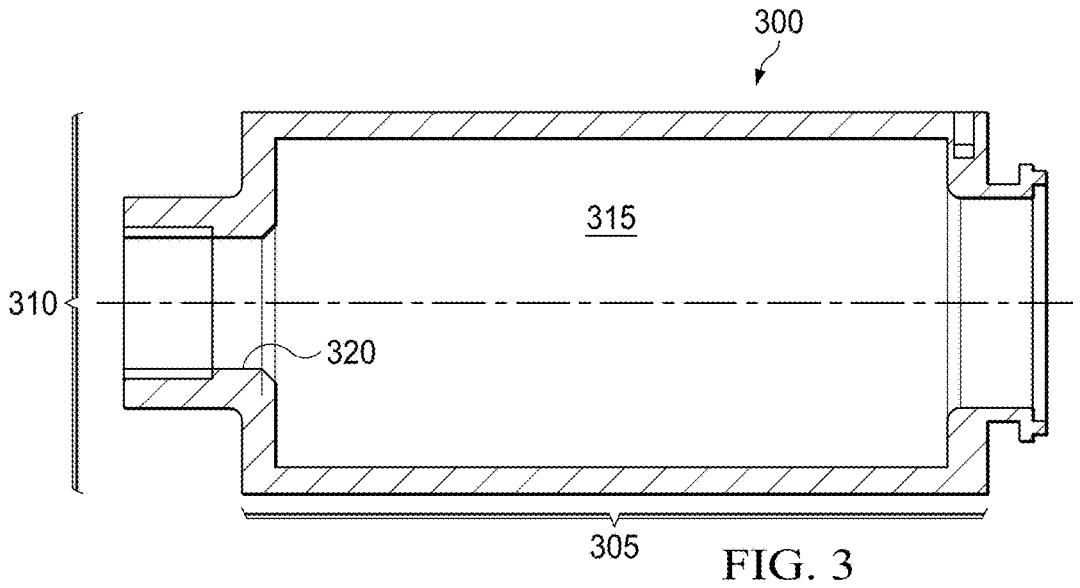
FIG. 3 illustrates an example cross section of a backshell according to this disclosure.

FIG. 3 illustrates an example cross section 300 of a backshell 130 according to this disclosure. The embodiment of the backshell 130 illustrated in FIG. 3 is for illustration only. FIG. 3 do not limit the scope of this disclosure to any particular implementation.

The backshell 130 is used to accommodate an excess amount 205 of the core cables 120. As shown in FIG. 3, the backshell 130 includes a shell that defines an interior space 315. The length 305 of the backshell 130 is less than the maximum excess amount 205 of the core cables 120. The length 305 and diameter 310 of the backshell 130 are selected to have an interior space 315 accommodate the excess amount 205 of the core cables 120. For example, for a SWA cable 100 that uses an AMPHENOL connection cap 135, the length 305 of the backshell could be 113 mm and the diameter 310 could be 57 mm. While maintaining the interior space 315 required for the excess amount 205 of the core cables 120, increasing the inner diameter 310 would require less length 305 for the back shell and the opposite is also true with decreasing the inner diameter 310 and extending the length 305. The backshell 130 provides extra interior space 315 for the core cables 120 to contract or expand without stressing the connections with the pins 210 of the connection cap 135. The edges 320 are rounded to protect the core cables from damage or fraying. The edges 320 could have any treatment provided to reduce the amount of damage from friction or rubbing of the core cables 120 on the edges 320.

Although FIG. 3 illustrates one example of a backshell 130 in a SWA cable 100, various changes may be made to FIG. 3. For example, the relative sizes and shapes of the components of the backshell 130 are merely one example; these components could be changed to suit particular needs.

Figure 4:
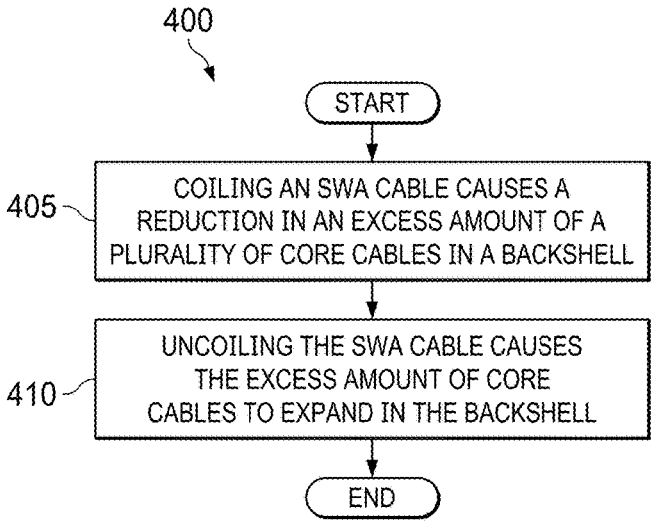
FIG. 4 illustrates an example method for accommodating an excess amount of a plurality of core cables in a backshell according to this disclosure.

FIG. 4 illustrates an example method 400 for accommodating an excess amount 205 of a plurality of core cables 120 in a backshell 130 according to this disclosure. For example, the process depicted in FIG. 4 may be performed in conjunction with an SWA cable 100 in FIG. 1.

In operation 405, the SWA cable 100 is coiled causing a reduction in the excess amount 205 of the core cables 120 in a backshell 130. The difference in the bending radius between the steel armor wires 110 and the core cables 120 cause the core cables 120 to bend more than the steel armor wires 110. This difference in bending radius causes a reduction in the excess amount 205 of the core cables 120 encased in the backshell 130. The excess amount 205 is determined based on the reduction in length based on the maximum amount of bending while the SWA cable 100 is coiled.

In operation 410, the SWA cable 100 is uncoiled causing the excess amount 205 of the core cables 120 to expand in the backshell 130. Because the bending radii are different, when the SWA cable 100 is uncoiled, the excess amount 205 returns to the position when the SWA cable 100 is straight or an increase in the excess amount 205 of the core cables 120 from the coiled state. The interior space 315 of the backshell 130 provides an area for the excess amount 205 of core cables 120 to remain while the SWA cable 100 is straight or uncoiled.

Although FIG. 4 illustrates one example of a method 400 for accommodating an excess amount 205 of a plurality of core cables 120 in a backshell 130, various changes may be made to FIG. 4. For example, various steps shown in FIG. 4 could overlap, occur in parallel, occur in a different order, or occur any number of times.

It may be advantageous to set forth definitions of certain words and phrases used throughout this patent document. The terms "transmit," "receive," and "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A backshell comprising:

a shell defining an interior space, the interior space configured to encase a portion of a plurality of core cables between an entry component and a connector body in a steel wire armored (SWA) cable, wherein the portion represents an excess amount of the core cables when the SWA cable is uncoiled, and wherein the shell is provided between a cable gland assembly and a connection cap to encompass and accommodate the excess amount of the core cables.

2. The backshell of claim 1, wherein the excess amount of the core cables is reduced when the SWA cable is coiled.

3. The backshell of claim 1, wherein the excess amount of the core cables is increased when the SWA cable is uncoiled.

4. The backshell of claim 1, wherein a length of the backshell is less than a length of the core cables between the cable gland assembly and the connection cap.

5. The backshell of claim 1, wherein the excess amount of the core cables is determined based on an overall length of the core cables.

6. The backshell of claim 1, wherein the excess amount of the core cables is determined based on an overall length of the SWA cable.

7. The backshell of claim 1, wherein a length of the backshell is determined based on a diameter of an inside of the backshell.

8. A steel wire armored (SWA) cable comprising:

a plurality of core cables configured to transmit a signal; and a backshell comprising a shell defining an interior space, the interior space configured to encase a portion of the plurality of core cables between an entry component and a connector body in the SWA cable, wherein the portion represents an excess amount of the core cables when the SWA cable is uncoiled, and wherein the shell is provided between a cable gland assembly and a connection cap to encompass and accommodate the excess amount of the core cables.

9. The SWA cable of claim 8, wherein the excess amount of the core cables is reduced when the SWA cable is coiled.

10. The SWA cable of claim 8, wherein the excess amount of the core cables is increased when the SWA cable is uncoiled.

11. The SWA cable of claim 8, wherein a length of the backshell is less than a length of the core cables between the cable gland assembly and the connection cap.

12. The SWA cable of claim 8, wherein the excess amount of the core cables is determined based on an overall length of the core cable.

13. The SWA cable of claim 8, wherein the excess amount of the core cables is determined based on an overall length of the SWA cable.

14. The SWA cable of claim 8, wherein a length of the backshell is determined based on a diameter of an inside of the backshell.

15. A method comprising:

coiling a steel wire armored (SWA) cable having a plurality of core cables, wherein the coiling of the SWA cable causes a reduction in an excess amount of the plurality of core cables disposed in an interior space of a backshell coupled to the SWA cable; and uncoiling the SWA cable, wherein the uncoiling of the SWA cable causes the excess amount of the core cables to increase in the interior space of the backshell, and wherein the backshell is provided between a cable gland assembly and a connection cap to encompass and accommodate the excess amount of the core cables.

16. The method of claim 15, wherein a length of the backshell is less than a length of the core cables between the cable gland assembly and the connection cap.

17. The method of claim 15, wherein the core cables have a different bending radius than the SWA cable when the SWA cable is coiled.

18. The method of claim 15, wherein the excess amount of the core cables is determined based on an overall length of the core cables.

19. The method of claim 15, wherein the excess amount of the core cables is determined based on a maximum amount of bending in the SWA cable.

20. The method of claim 15, wherein a length of the backshell is determined based on a diameter of the interior space of the backshell.

* * * * *